US006200396B1

(12) United States Patent
Laslaz et al.

(10) Patent No.: US 6,200,396 B1
(45) Date of Patent: Mar. 13, 2001

(54) HYPEREUTECTIC ALUMINIUM-SILICON ALLOY PRODUCT FOR SEMI-SOLID FORMING

(75) Inventors: Gerard Laslaz, Le Cheylas; Francois Cossé , Grenoble; Michel Garat, Saint Quentin sur Isere, all of (FR)

(73) Assignee: Aluminium Pechinay, Paris (FR)

( * ) Notice: Subject to any disclaimer, the term of this patent is extended or adjusted under 35 U.S.C. 154(b) by 0 days.

(21) Appl. No.: 09/455,766

(22) Filed: Dec. 7, 1999

(30) Foreign Application Priority Data

Jan. 21, 1999 (FR) ..... 99 00787

(51) Int. Cl.[7] ..... C22C 21/02; C22C 21/04
(52) U.S. Cl. ..... 148/437; 420/534; 420/548
(58) Field of Search ..... 148/437, 438, 148/439, 440; 420/534, 535, 548

(56) References Cited

U.S. PATENT DOCUMENTS

| | | | | |
|---|---|---|---|---|
| 4,681,736 | * | 7/1987 | Kersker et al. | 420/535 |
| 5,009,844 | | 4/1991 | Laxmanan . | |
| 5,217,546 | * | 6/1993 | Eady et al. | 148/549 |
| 5,701,942 | * | 12/1997 | Adachi et al. | 164/71.1 |
| 5,879,478 | * | 3/1999 | Loue et al. | 148/438 |
| 5,968,292 | * | 10/1999 | Bergsma | 148/437 |

FOREIGN PATENT DOCUMENTS

| | | | |
|---|---|---|---|
| 554808 | * | 1/1993 | (EP) . |
| 553533 | * | 8/1993 | (EP) . |
| 0572683 | | 12/1993 | (EP) . |
| 8323461 | | 12/1996 | (JP) . |
| 96/38593 | * | 12/1996 | (WO) . |

OTHER PUBLICATIONS

XP 000607979–Semi–Solid Processing of Hypereutectic AL/SI Alloys, Kahlen et al, vol. 1, pp. 83–90.

* cited by examiner

*Primary Examiner*—George Wyszomierski
*Assistant Examiner*—Janelle Combs Morillo
(74) *Attorney, Agent, or Firm*—Dennison, Scheiner, Schultz & Wakeman

(57) ABSTRACT

This invention relates to a eutectic or hypereutectic aluminium-silicon alloy product suitable for thixoforming, comprising (by weight) 10 to 30% silicon and, if applicable, copper (<10%), magnesium (<3%), manganese (<2%), iron (<2%), nickel (<4%), cobalt (<3%) and other elements (<0.5% each and 1% in total), the microstructure of which is composed of primary silicon crystals, equiaxed type aluminium dendrites less than 4 mm in size and a eutectic composed of eutectic silicon grains and eutectic aluminium grains less than 4 mm in size.

3 Claims, No Drawings

HYPEREUTECTIC ALUMINIUM-SILICON ALLOY PRODUCT FOR SEMI-SOLID FORMING

FIELD OF THE INVENTION

The invention relates to Al-Si alloy products, with other added elements, if applicable, in which the silicon content is such that it is greater than or equal to the composition of the eutectic (11.7% if no other elements are added). These products, such as billets, then cut into slugs corresponding to the quantity of metal required for the part to be manufactured, or forging blanks, are intended to be heated in the semi-solid state, i.e. at a temperature between the alloy's solidus and liquidus, to be formed, particularly by forging or pressure die injection.

DESCRIPTION OF RELATED ART

The aluminium-silicon alloys, comprising, if applicable, other added elements such as copper, magnesium, manganese, zinc, nickel or cobalt, and in which the silicon content is greater than or equal to that of the eutectic, are used for the manufacture of moulded parts with low heat expansion and good friction resistance, e.g. pistons and internal combustion engine jackets, or braking or clutch system parts. However, these alloys are relatively difficult to mould and machine and this difficulty increases with the silicon content.

Therefore, it is of interest to have a process which prevents the complete melting of the alloy and results in a shape as close as possible to the desired final shape for the manufactured part. This is the case for semi-solid forming or thixoforming. This technique has been developed over the last twenty years following Prof. Fleming's work at the MIT, particularly for aluminium alloys. It consists of casting semi-finished products such as billets while subjecting them to a shearing force, e.g. by mechanical or electromagnetic stirring, so as to change the dendritic solidification structure into a spheroidised structure, heating the pieces of these semi-finished products to the semi-solid state and forming them by pressure die injection or forging. The parts obtained are metallurgically sound, free of cavities and segregation and the process enables high outputs particularly suitable for automobile industry mass production runs.

Most industrial applications use the 7% silicon AS7G alloy (A356 and 357 according to the Aluminium Association reference). Hypereutectic aluminium alloy thixoforming is described in the patent application EP 0572683 filed by Honda Giken. This application recommends to start with a solid material in which the maximum primary silicon crystal grain size is less than 100 $\mu$m, which prevents excessively rapid wear of the injection mould gate and cavity. The application does not give any indication on the casting process used to produce such a structure.

The patent application JP 08-323461 (Asahi Tec) describes a hypereutectic Al-Si alloy semi-solid forming process, in which the shearing intended to improve the rheology and filling of the mould are concomitant, such that the incoming metal introduces circulation which results in a thixotropic structure and reduces primary silicon crystal segregation.

The introduction of the article by I. Diewwanit and M. C. Flemings "Semi-Solid Forming of Hypereutectic Al-Si Alloys" Light Metals 1996, The Minerals, Metals & Materials Society, pp. 787–793, includes a complete presentation of the bibliography on semi-solid forming of hypereutectic Al-Si alloys and describes rheomoulding tests with mechanical stirring. None of the methods described provide a simple improvement of the thixoforming capacity of hypereutectic aluminium alloys.

In addition, the patent U.S. Pat. No. 5,701,942 (Ube Industries) describes a hypoeutectic aluminium semi-solid application process. The examples show different compositions with silicon contents ranging from 3 to 11% and a composition with 7% Si, 0.15% Ti and 0.005% B, which represents a significant excess of Ti with reference to the stoechiometric proportion corresponding to $TiB_2$.

SUMMARY OF THE INVENTION

The applicant discovered that it was possible to obtain, for eutectic or hypereutectic Al-Si alloys, very favourable semi-solid rheological properties for thixoforming using a solid product with a particular solidification structure, obtained in a simple manner without mechanical or electromagnetic stirring.

This invention relates to a eutectic or hypereutectic aluminium-silicon alloy product suitable for thixoforming, comprising (by weight) 10 to 30% silicon and, if applicable, copper (<10%), magnesium (<3%), manganese (<2%), iron (<2%), nickel (<4%), cobalt (<3%) and other elements (<0.5% each and 1% in total), the raw casting microstructure of which is composed of primary silicon crystals, equiaxed type aluminium dendrites less than 4 mm in size and a eutectic composed of eutectic silicon grains and eutectic aluminium grains less than 4 mm in size.

It also relates to a process to obtain this microstructure consisting of adding 50 to 2000 ppm (by weight) of boron to the alloy, with the quantity added in excess with reference to that strictly necessary for impurity precipitation.

DETAILED DESCRIPTION OF THE INVENTION

The hypereutectic Al-Si alloy solidification structure, as observed on a metallographic section, comprises:

a) primary silicon particles, the size of which may be refined, particularly by adding 20 to 500 ppm of phosphorus, b) aluminium dendrites formed at the beginning of the eutectic stage, which often reach sizes greater than 5 mm, c) a eutectic composed of eutectic silicon grains and eutectic aluminium grains and, if applicable, intermetallic phases using the other alloy elements such as Cu, Mg or Ni. The size of the eutectic aluminium grains is correlated to that of the dendrites and approximately of the same value. It is possible to reveal the presence and size of these columnar eutectic aluminium grains using the ferric chloride or three-acid etch process on the specimen.

The applicant observed that, when either the aluminium dendrites or the eutectic aluminium grains were columnar (or basaltic) in shape and greater than 4 mm in size, the heated semi-solid product up to a liquid fraction content of 20 and 60% had a poorly spheroidised structure, with the eutectic aluminium grains showing an elongated shape resulting in an unfavourable rheology for forming under good conditions. However, if the dendrites and eutectic aluminium grains had an equiaxed type structure, with a size less than 4 mm, the heated semi-solid product structure is correctly spheroidised, resulting in a favourable rheology for easy forming of the part to be produced and good metallurgical quality of the part.

It is important that the structure according to the invention is found in the entire slug or blank to be heated. If this structure only exists in part of the piece, the heterogeneity of the structure results in problems during forming.

An effective, reliable and repeatable way to obtain the structure according to the invention, without having to use mechanical or electromechanical stirring, is to add 0.005 to 0.2%, preferably 0.01 to 0.05%, of boron to the liquid metal to be cast in the form of a billet or blank.

Boron is generally used for the purification of aluminium, to precipitate impurities such as Ti, Zr, Mn or V in the form of intermetallic borides. Titanium and boron master alloys, such as A-T5B, are also generally used to refine the aluminium grain, by forming $TiB_2$ particles; in these alloys, the titanium is in excess with reference to the stoechiometric quantity required for the formation of $TiB_2$ and the total boron content does not exceed 50 ppm.

It is essential that the added boron according to the invention is at least 0.005% in excess with reference to the stoechiometric quantity strictly necessary to eliminate impurities in the form of intermetallic compounds. Boron may be added in the form of Al-B (e.g. A-B3 or A-B6 alloys), Si-B or Al-Si-B (e.g. A-S10B3 alloy) master alloys. It may also be added in the form of a fluoborate flux.

The products according to the invention may be used for any usual application of eutectic or hypereutectic alloys containing up to 30% silicon, particularly parts subject to intense wear-friction, such as brake drums and disks, engine or compressor cylinders or jackets, pistons and gearshift forks.

EXAMPLES

A-S17U4G alloys containing (by weight) 17% Si, 4% Cu and 0.6% Mg were produced, with an addition of 100 ppm of phosphorus to refine the primary silicon grains. Alloy A did not contain any other additions, alloy B was produced with an addition of 0.15% titanium and 0.3% AT5B, a 5% titanium and 1% boron master alloy. Alloy C according to the invention was produced with an addition of 0.03% boron. The metal was cast in the form of 75 mm diameter billets by semi-continuous casting under pressure, with no mechanical or electromagnetic stirring.

The examination of a metallographic section of a billet of alloy A demonstrated, either for the entire billet cross-section, or at least on the part nearest the perimeter, a structure comprising columnar (or basaltic) aluminium dendrites and eutectic aluminium grains between 3 and 10 mm in size. After semi-solid heating, at a liquid fraction content of approximately 40%, it was observed that the eutectic aluminium was not spheroidised. The rheology test revealed that this metal was unsuitable for semi-solid forming. Although the central part of the billet showed a less unfavourable structure, the thixoforming mould filling posed problems due to the heterogeneity of the rheology between the centre and the edge.

The examination of a section of billet of alloy B showed a combined structure, more columnar towards the outside of the billet and more equiaxed towards the centre, with the size of the dendrites and eutectic aluminium grains varying between 0.2 and 10 mm. After semi-solid heating, a partially spheroidised structure was obtained. As in the previous case, the heterogeneity of the structure resulted in variations of the rheology, leading to mould filling problems.

For the billet of alloy C according to the invention, the examination of a section revealed a structure with equiaxed aluminium dendrites and grains, conveying a homogeneous nucleation, between 0.2 and 2 mm in size. After semi-solid heating, the eutectic aluminium was perfectly spheroidised and the rheology test was systematically satisfactory.

What is claimed is:

1. Eutectic or hypereutectic aluminium-silicon alloy product suitable for thixoforming, consisting essentially of, by weight:

| | |
|---|---|
| silicon | 10 to 30%; |
| boron | 0.005 to 0.2%; |
| copper | 0–10%; |
| magnesium | 0–3%; |
| manganese | 0–2%; |
| iron | 0–2%; |
| nickel | 0–4%; |
| cobalt | 0–3%; |
| other elements | <0.5% each and <1% total; |
| aluminum | remainder; |

the alloy containing at least 0.005% non-associated boron, said boron being in excess of a stoichiometric amount necessary to form an intermetallic compound with at least one element selected from the group consisting of Ti, Zr, Mn and V, the product having a microstructure comprising primary silicon crystals, aluminum dendrites less than 4 mm in size, and a eutectic comprising eutectic silicon grains and eutectic aluminum grains less than 4 mm in size.

2. Product according to claim 1, comprising 0.002 to 0.05% phosphorus.

3. Product according to claim 1, comprising 0.01 to 0.05% boron.

* * * * *